US007258619B2

(12) United States Patent
Tuckey

(10) Patent No.: US 7,258,619 B2
(45) Date of Patent: Aug. 21, 2007

(54) HANGER MOUNTS FOR CHILD SWING

(75) Inventor: Peter R. Tuckey, Morgantown, PA (US)

(73) Assignee: Wonderland Nursery goods Co., Ltd., Taipei (TW)

( * ) Notice: Subject to any disclaimer, the term of this patent is extended or adjusted under 35 U.S.C. 154(b) by 69 days.

(21) Appl. No.: 11/283,450

(22) Filed: Nov. 18, 2005

(65) Prior Publication Data

US 2006/0128486 A1 Jun. 15, 2006

Related U.S. Application Data

(60) Provisional application No. 60/631,462, filed on Nov. 29, 2004.

(51) Int. Cl.
*A63G 9/16* (2006.01)

(52) U.S. Cl. ..... 472/119

(58) Field of Classification Search ..... 472/118–125; 297/273–279

See application file for complete search history.

(56) References Cited

U.S. PATENT DOCUMENTS

| | | | | |
|---|---|---|---|---|
| D345,777 | S | 4/1994 | Pinch | D21/246 |
| 5,525,113 | A | 6/1996 | Mitchell | 472/119 |
| D392,126 | S | 3/1998 | Sack | D6/491 |
| 5,833,545 | A | 11/1998 | Pinch | 472/119 |
| 6,059,667 | A | 5/2000 | Pinch | 472/119 |
| 6,386,986 | B1 * | 5/2002 | Sonner et al. | 472/119 |
| 6,471,597 | B1 * | 10/2002 | Flannery et al. | 472/119 |
| 6,500,072 | B1 | 12/2002 | Myers | 472/119 |
| 6,626,766 | B1 * | 9/2003 | Hsia | 472/119 |

* cited by examiner

*Primary Examiner*—Kien Nguyen
(74) *Attorney, Agent, or Firm*—Miller Law Group, PLLC

(57) ABSTRACT

An attachment apparatus provides a quick connection of the hanger tubes for a child's swing seat assembly to the pivot member of a drive mechanism powering the reciproal movement of the seat assembly. The shape of the mating attachment members, including a rounded upper portion and linear side portions, provides an intuitive and effective mounting apparatus for a swing seat assembly that can be accomplished simply by sliding the hanger tubes over or into the mating receptacles. A quick disconnect device engages automatically and provides a secure connection between the hanger tube and the receptacle. Removal of the seat assembly requires only a release of the quick disconnect device and a lifting of the seat assembly from the frame apparatus. In one embodiment the linear side portions are angled into a wedge-shape to ensure proper seating and driving connection to transmit torque to the hanger tubes.

20 Claims, 8 Drawing Sheets

Fig. 10
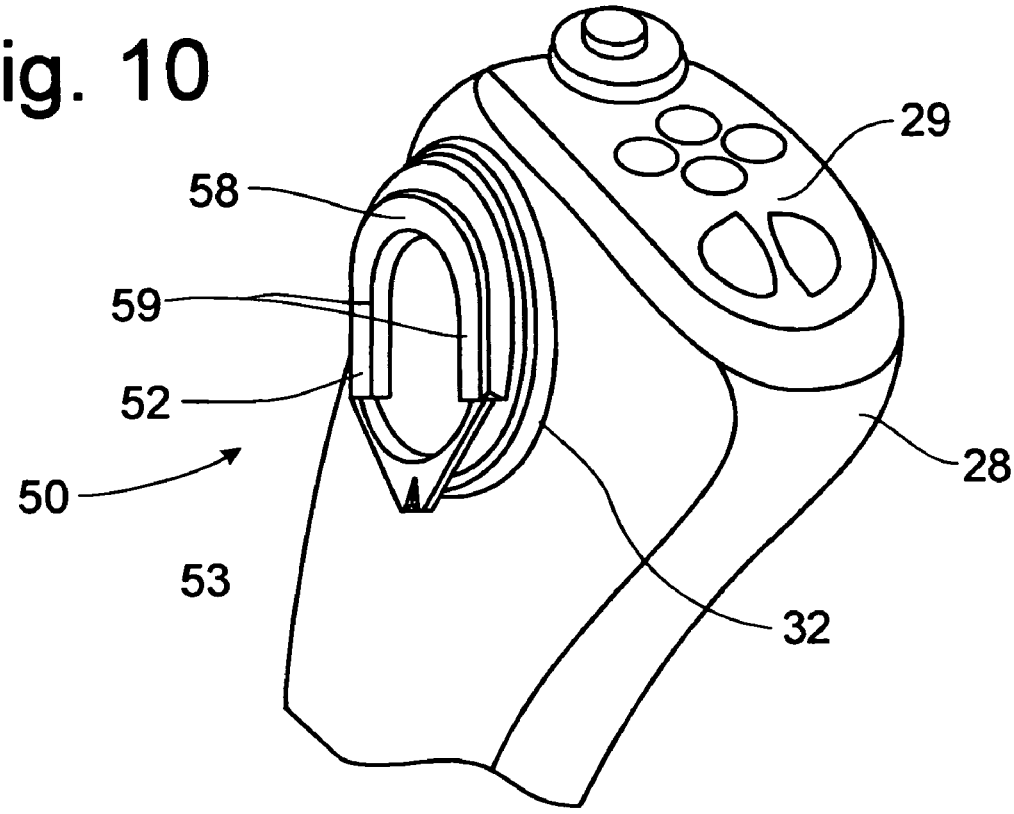
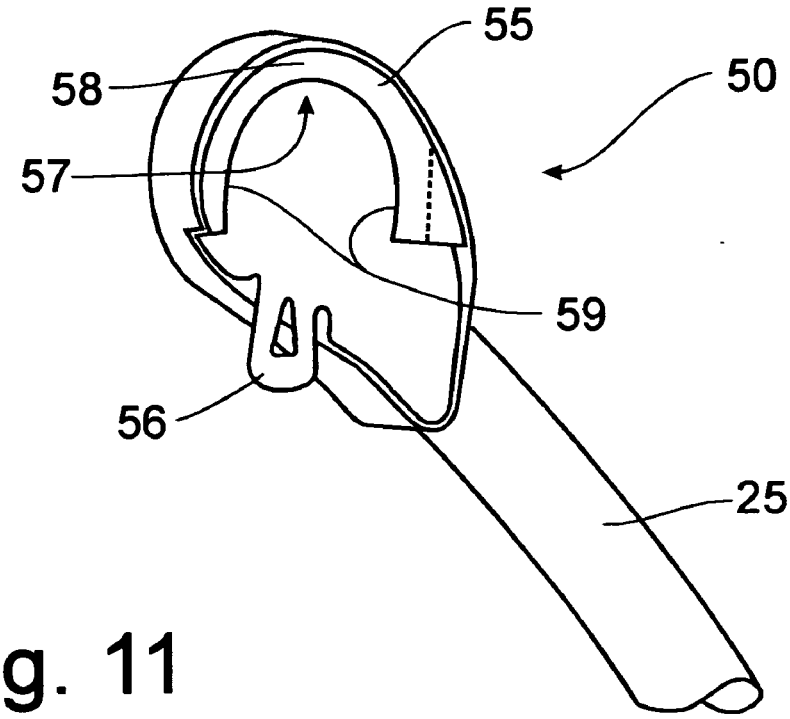
Fig. 11

HANGER MOUNTS FOR CHILD SWING

CROSS-REFERENCE TO RELATED APPLICATIONS

This application claims priority on U.S. Provisional Patent Application Ser. No. 60/631,462, filed on Nov. 29, 2004, the entire contents of which are incorporated herein by reference.

BACKGROUND OF THE INVENTION

The present invention relates generally to a frame for an infant swing and, more particularly, to a hanger mount structure that provides convenient utilization while ensuring that the electric motor is operable to transmit torque to the hanger members to affect reciprocal movement thereof.

Baby swings are used extensively by infant caregivers to soothe and to comfort the children. An infant swing consists primarily of a seat that securely holds the infant in a position elevated off the floor and a frame apparatus that supports the seat and allows the seat to move in a reciprocal manner, typically in a forward and rearward direction though some infant seats provide a side to side swinging motion.

The first infant swings consisted of a seat suspended from a frame that was formed with a support structure that extended over top of the infant and was supported by transversely opposed support legs that hold the overhead support structure in the elevated position. This overhead support structure restricted access to the child positioned in the seat as the support structure presented a physical barrier directly above the child. Such an infant swing can be seen in U.S. Design Patent No. D345,777, issued on Apr. 4, 1994, to Daniel Pinch, et al. Not only is the overhead support structure a barrier to accessing the child in the swing from above the child, but the support structure also presented a barrier to viewing the infant.

As a solution to the barrier presented by the overhead support structure, the "open top" infant swing was developed. As can be seen in U.S. Pat. No. 4,822,033, issued to Louis Kohus and James Mariol on Apr. 18, 1989, the overhead structural support has been eliminated to provide an open access to the child in the seat from above. However, the child can be capable of grasping either of the transversely opposing support legs, particularly as the child is swinging back and forth between the support legs. Contact between the swinging child and one of the support legs can result in injury to the child. Furthermore, the child can potentially grab one of the support legs and pull his or herself forwardly to become dislodged from the seat, particularly if the child has not been properly secured within the seat by a safety harness.

The aforementioned open top infant swing evolved in a manner to eliminate the frame structure, i.e. the support legs, positioned forwardly of the swinging seat to provide an "open side" swing frame configuration for an infant swing. Such an open side infant swing can be found in the aforementioned U.S. Pat. No. 4,822,033, issued to Kohus and Mariol on Apr. 18, 1989. In the Kohus and Mariol patent, the infant swing is provided with both an open top and an open side structural configuration to provide the capability of viewing and accessing the child within the seat from substantially any position forwardly of the seat.

The swinging motion of most baby swings commercially available is similar to that of a pendulum that pivots from above and to the sides of the seat. Although this swinging motion can be maintained by a mechanical spring-operated swing mechanism, the swinging motion in most modern infant swings is maintained, typically, by a small electric motor located adjacent one of the seat pivots supported by the frame structure. The power for this electric motor is typically an array of dry cell batteries located within the same plastic housing as the electric motor. Examples of battery operated motors to affect the swinging motion of the infant seat from a frame support can be seen in U.S. Pat. No. 5,525,113, issued to Daniel Mitchell, et al on Jun. 11, 1996, and in U.S. Pat. No. 5,833,545, issued to Daniel Pinch, et al on Nov. 10, 1998.

Most current commercial infant swings utilize an assembly that involves inserting a hanger tube into a receptacle, which is incorporated as an integral part of the pivot member for the swing. A mechanical fastener, such as a screw, bolt and nut, or spring-loaded button, is then used to retain the hanger tube in the receptacle. Such an attachment apparatus requires that the consumer verify that the fasteners are correctly installed during assembly, which is often difficult due to strategic alignment of holes in the hanger tube with corresponding holes in the receptacle. Proper installation of such attachment devices is essential as the swing seat can come loose from the pivot member and fall. Disassembly of the swing seat from the frame assembly can also present a burdensome operation as these fasteners must be removed and stored so that the fasteners can be reused later when the swing is re-assembled.

Accordingly, it would be desirable to provide a mounting apparatus for the seat assembly of a child swing that can provide an intuitive and effective operation in assembly and disassembly of the swing.

SUMMARY OF THE INVENTION

It is an object of this invention to provide a hanger mount attachment apparatus for an infant swing that overcomes the aforementioned disadvantages of the prior art.

It is a feature of this invention that the hanger tubes are formed with a mating configuration to the configuration of the receptacle on the swing pivot member.

It is another feature of this invention that the mating configurations of the hanger tube and the frame supported receptacle are formed with a rounded top portion and a wedge-shaped shape.

It is an advantage of this invention that the mated hanger tube and frame mounted receptacle are effective in transmitting torque from the pivot member connected to the electric motor powering the reciprocal movement of the seat assembly.

It is yet another feature of this invention that the configurations of the hanger tube and the frame-mounted receptacle incorporate a mating quick disconnect device to allow the selectively detachable connection of the hanger tubes to the frame-mounted receptacle.

It is another advantage of this invention that the mounting of the hanger tubes onto the frame-mounted receptacle is intuitive to the consumer and easily utilized.

It is still another advantage of this invention that the hanger tubes are mounted to the frame assembly simply by sliding the hanger tubes onto the pivot member receptacle to affect a secure attachment thereof.

It is yet another advantage of this invention that no fastener is required to affect a secure connection of the hanger tubes to the driven mechanism of the swing seat motor.

It is still another feature of this invention that the wedge shape of the attachment configurations provide a positive stop with respect to the interengagement of the hanger tubes and the frame-mounted receptacle.

It is still another object of this invention to provide a mounting apparatus for the connection of the hanger tubes of a swing seat assembly onto the pivot member of a reciprocal drive mechanism for swinging the seat assembly, which is durable in construction, inexpensive of manufacture, carefree of maintenance, facile in assemblage, and simple and effective in use.

These and other objects, features and advantages are accomplished according to the instant invention by providing an attachment apparatus for establishing a quick connection of the hanger tubes for a child's swing seat assembly to the pivot member of a drive mechanism powering the reciprocal movement of the seat assembly. The shape of the mating attachment members, including a rounded upper portion and linear side portions, provides an intuitive and effective mounting apparatus for a swing seat assembly that can be accomplished simply by sliding the hanger tubes over or into the mating receptacles. A quick disconnect device engages automatically and provides a secure connection between the hanger tube and the receptacle. Removal of the seat assembly requires only a release of the quick disconnect device and a lifting of the seat assembly from the frame apparatus. In one embodiment the linear side portions are angled into a wedge-shape to ensure proper seating and driving connection to transmit torque to the hanger tubes.

BRIEF DESCRIPTION OF THE DRAWINGS

The advantages of this invention will be apparent upon consideration of the following detailed disclosure of the invention, especially when taken in conjunction with the accompanying drawings wherein:

FIG. 10 is an enlarged perspective view of a second embodiment of a male attachment member forming a receptacle on the pivot member of a drive motor supported in the hanger housing at the elevated distal end of one of the rear legs of the frame assembly; and FIG. 11 is an enlarged perspective view of a second embodiment of a female attachment member formed on the end of a hanger tube for engagement with the male member depicted in FIG. 10.

DETAILED DESCRIPTION OF THE PREFERRED EMBODIMENT

Figure 6:
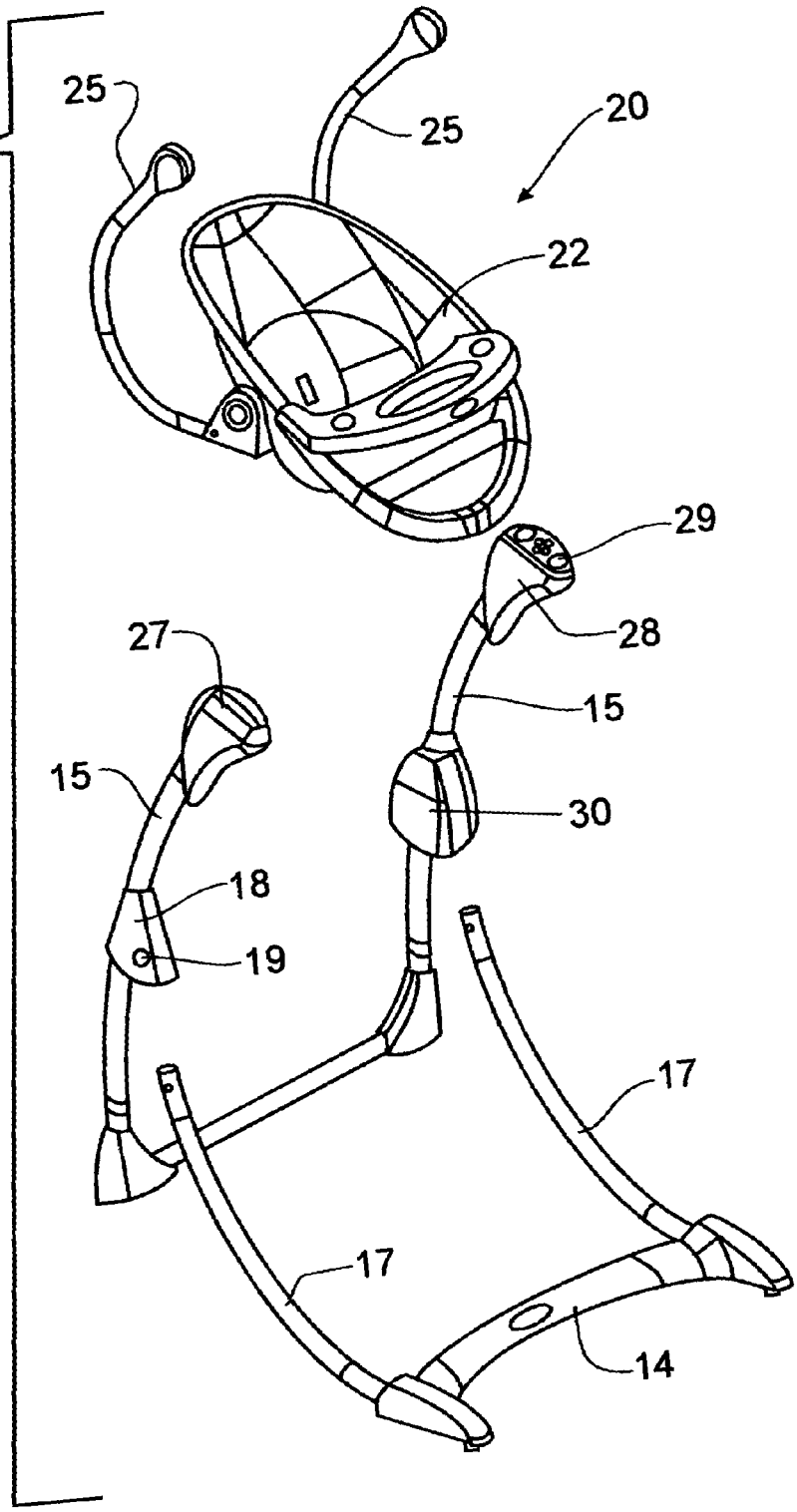
FIG. 6 is an exploded view of the major components of the infant swing disassembled to convert the infant swing into a more compact transport or storage configuration.
Figure 7:
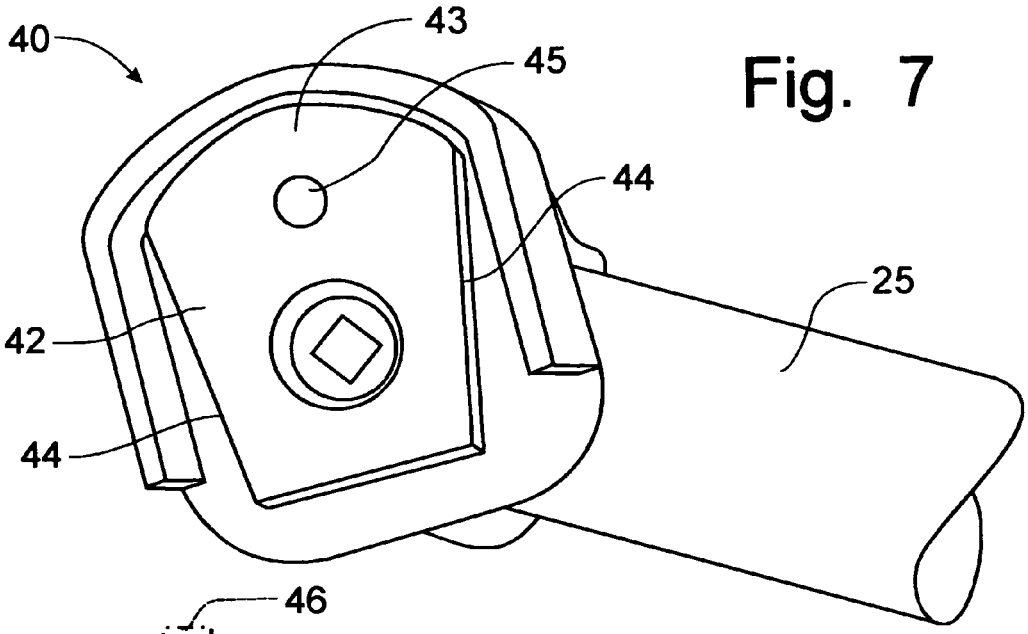
FIG. 7 is an enlarged perspective view of a first embodiment of a male attachment member on a hanger tube.

Referring now to the drawings, an infant swing having a frame apparatus incorporating the principles of the instant invention can best be seen. The infant swing 10, as can best be seen in FIG. 6, includes as the major components thereof a frame assembly 12, including a pair of transversely spaced rear legs 15 and a corresponding pair of front legs 17, and a seat assembly 20 suspended from the frame assembly 12 for a fore-and-aft swinging movement. The seat assembly 20 is formed of a molded seat member 22 and a pair of transversely spaced hangers 25 that are connected to corresponding hanger housings 27, 28 positioned at the cantilevered ends of the rear legs 15, as will be described in greater detail below.

Referring now to FIGS. 1-6, the frame assembly 12 is formed with a pair of transversely opposing rear legs 15 that extend upwardly and forwardly front a rearward support position with a curvature thereof being concave facing downwardly and forwardly. The rear legs 15 terminate at upper hanger housings 27, 28 at the elevated distal ends thereof. One of the hanger housings 28 is formed to encompass an electric motor 29 that is operable to move the seat assembly 20 in a reciprocal manner in a fore-and-aft direction. The curvature of the rear legs 15 provide an aesthetically pleasing shape that positions the hanger housings 27, 28 at an elevated, cantilevered position with no structure immediately below the hanger housings 27, 28.

A corresponding pair of curved front legs 17 is positioned forwardly of the rear legs 15 in fore-and-aft alignment therewith to extend rearwardly and upwardly from a front support position to intersect with the corresponding rear legs 17 at a central point thereof. Each of the rear legs 15 has mounted thereon at the central point thereof a mounting housing 18, 30 for the connection of the corresponding front leg 17 by a quick connect mechanism 19 that enables the front legs 17 to be detachably connected to the rear legs 17. The curvature of the front legs 17 is concave upwardly and forwardly so that the front legs 17 also do not provide any substantial structure beneath the hanger housings 27, 28. The mating curvatures of the rear legs 15 and the front legs 17 establish an open side configuration of the frame assembly 12 with respect to access to a seat assembly 20 hanging from the hanger housings 27, 28.

The front legs 17 are interconnected by a molded front cross brace 14, which preferably has a curved configuration to correlate with the curved front and rear legs 17, 15, and provide an aesthetically pleasing appearance. Similarly, the transversely opposing rear legs 15 are also interconnected by a rear cross brace member 13 to provide a stable support for the suspended seat assembly 20 to resist the forces associated with the fore-and-aft swinging of an infant positioned in the seat assembly 20. The curvature of the molded front cross brace 14 eliminates the conventional tubular structural member that is positioned between the front legs. The rearwardly curved shape enables the caregiver to approach the seat assembly 20 for insertion or removal of the child from the seat member 22 without interfering with or tripping over the front cross brace found on conventional infant swings.

The seat assembly 20 includes a molded seat member 22 that is more particularly described in co-pending and commonly owned U.S. patent application Ser. No. 11/283,449, filed on Nov. 18, 2005, by Robert E. Haut, the contents of which are incorporated herein by reference. The seat member 22 provides a support structure in which an infant can be placed and secured within the seat member 22 by conventional safety restraints (not shown) and permitted to reciprocally swing in a fore-and-aft direction. The seat member 22 is supported from the hanger housings 27, 28 by curved hangers 25 that connect with the seat member 22 and present a concave shape in a forward direction. As a result, the curvature of the hangers 25 contributes to the structure-free configuration beneath the hanger housings 27, 28, in addition to the mating curvatures of the front and rear legs 17, 15, to establish the open side configuration for access to the seat member 22.

Figure 1:
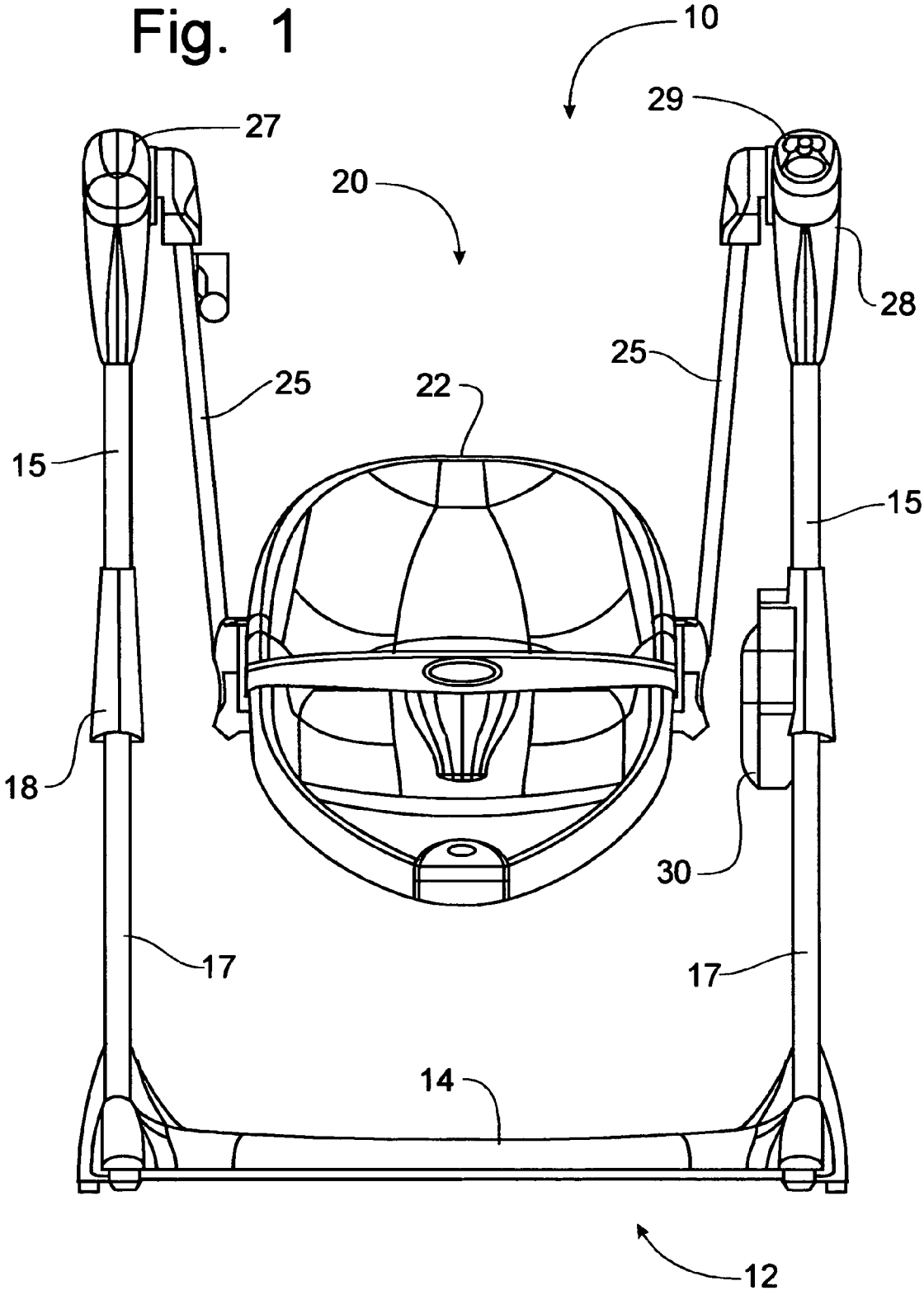
FIG. 1 is a front elevational view of an infant swing having a frame apparatus incorporating the principles of the instant invention.
Figure 2:
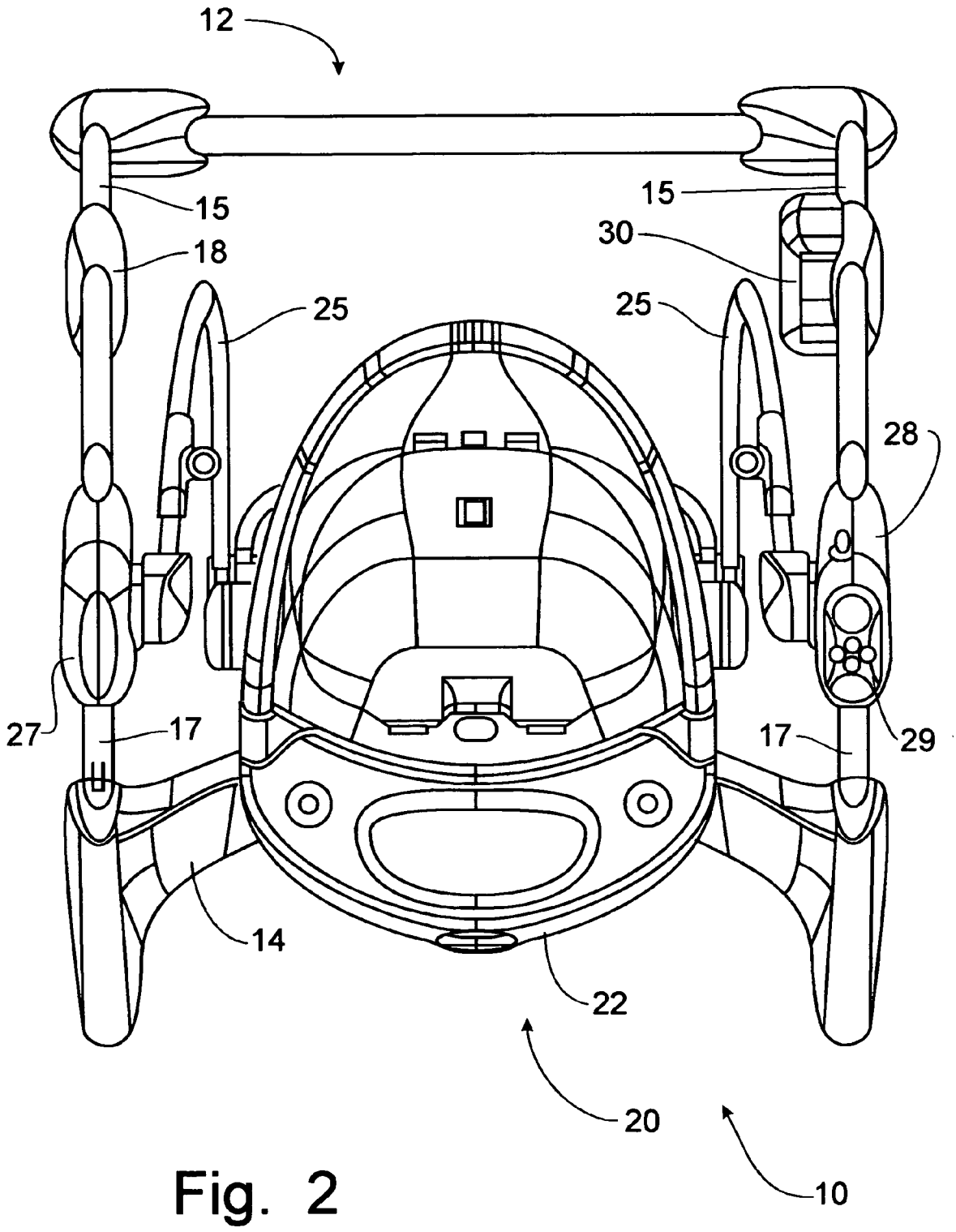
FIG. 2 is a top plan view of the infant swing depicted in FIG. 1.
Figure 3:
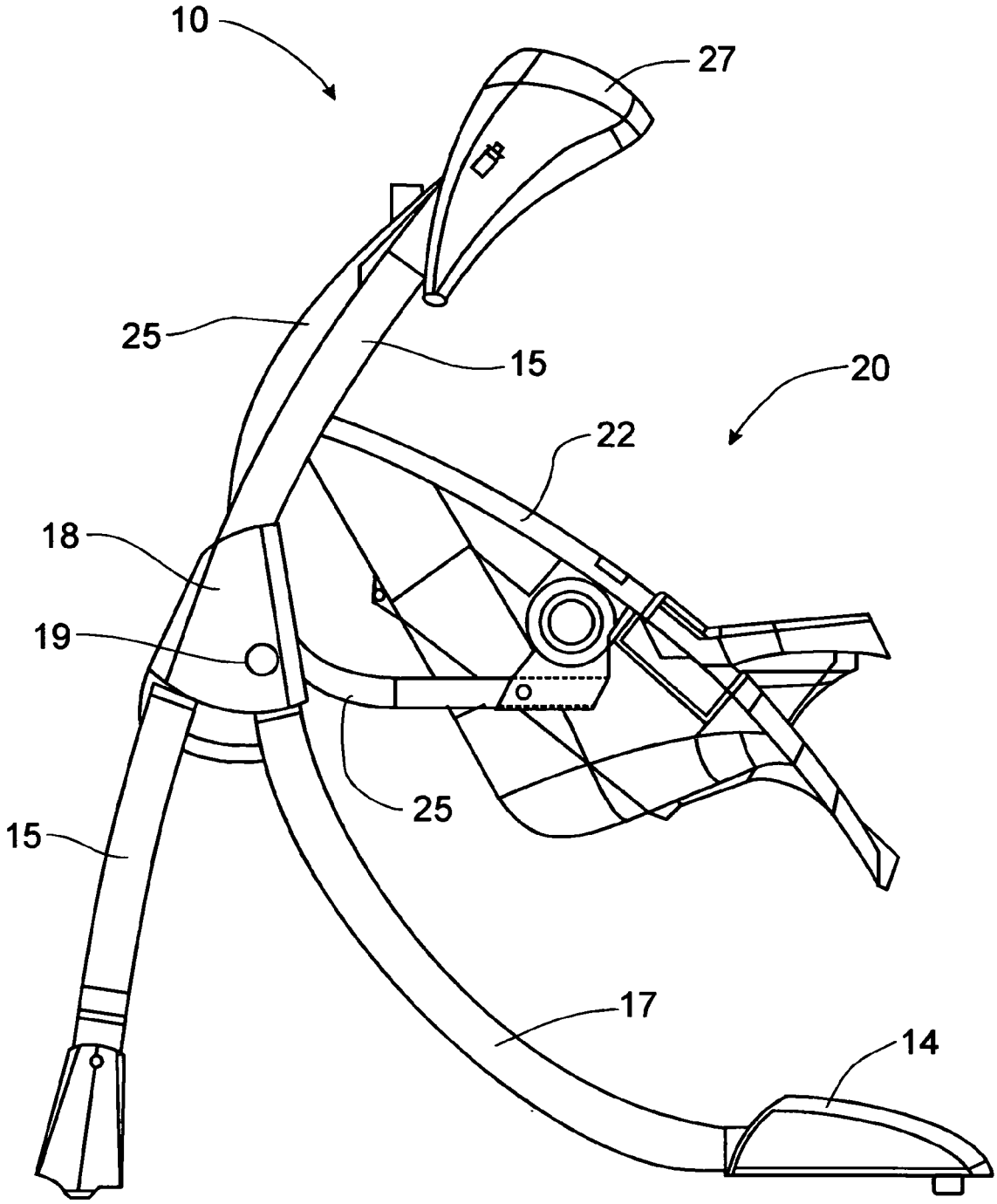
FIG. 3 is a right side elevational view of the infant swing shown in FIGS. 1 and 2.
Figure 4:
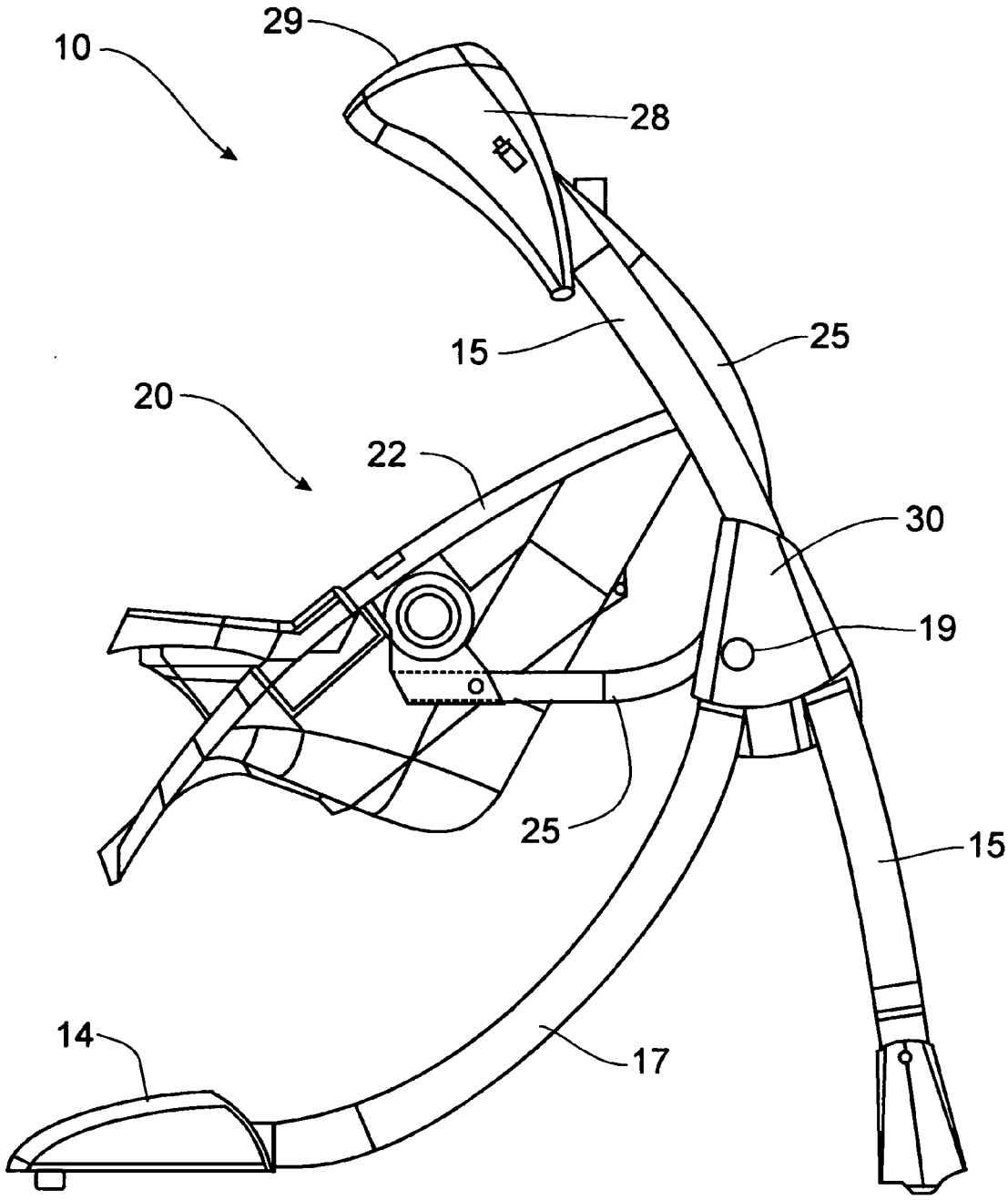
FIG. 4 is a left side elevational view of the infant swing shown in FIGS. 1 and 2.
Figure 5:
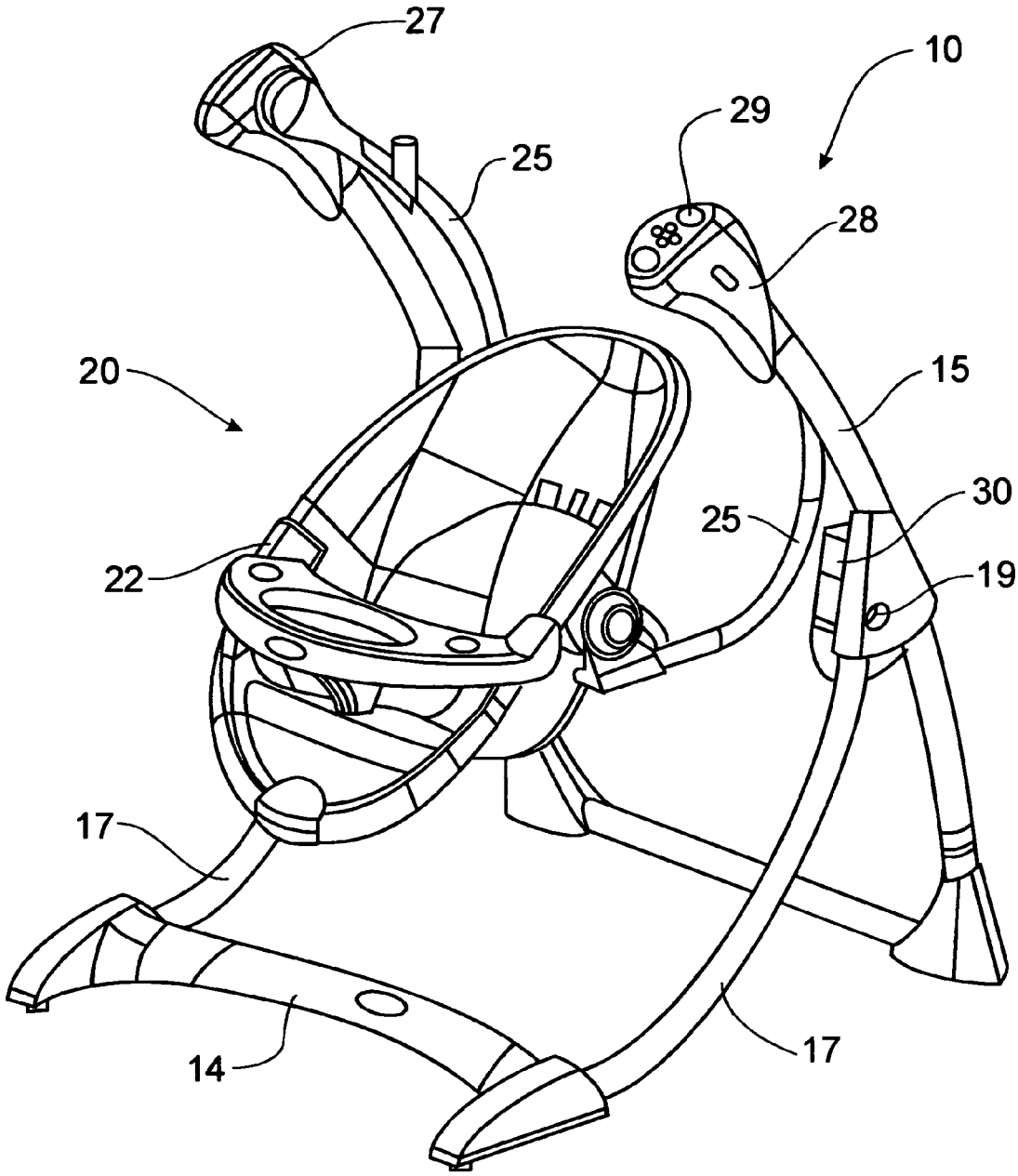
FIG. 5 is a left, front perspective view of the infant swing shown in FIGS. 1 and 2.
Figure 5A:
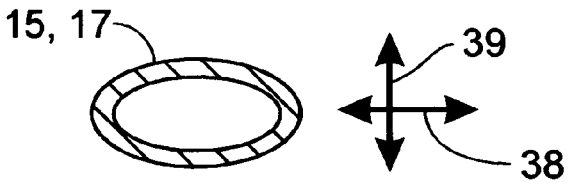
FIG. 5A is an enlarged cross-sectional view of a frame member corresponding to either of the front or rear legs to depict the oval-shaped cross-sectional configuration of the frame member.
Figure 8:
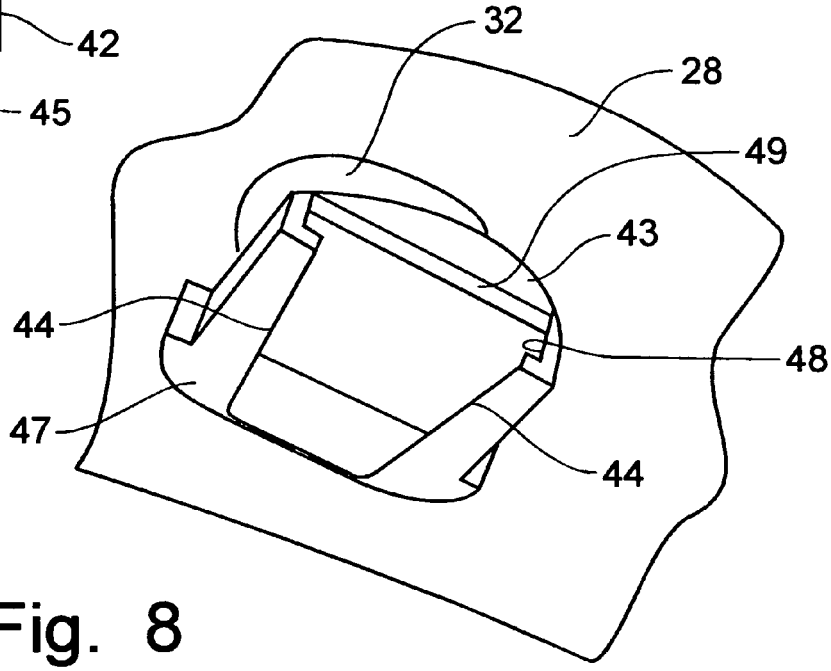
FIG. 8 is an enlarged perspective view of a first embodiment of a female attachment receptacle mounted on the pivot member of a drive motor supported in the hanger housing at the elevated distal end of one of the rear legs of the frame assembly.

As is best seen in FIG. 5A, the structural members forming the front and rear legs 17, 15 are formed from an oval-shaped tubular member, preferably tubular aluminum that has been rolled into the oval shape shown in FIG. 8 that provides a longer dimension in a direction parallel with the swinging movement of the seat assembly 12, depicted by the arrow 38, than in the direction perpendicular to the swinging movement of the seat assembly 12, represented by arrow 39. This oval-shaped cross-sectional configuration of the structural frame members provides a frame that is stronger in the resistance of the swinging motion than a frame having the same amount of material but formed in a conventional round cross-sectional configuration.

The transversely spaced hanger housings 27, 28 without any structural member interconnecting the upper distal ends of the rear legs 17 provides an open top configuration for the frame assembly 12, while the curved rear and front legs 15, 17, along with the curved hangers 25, provide an open side configuration for the frame assembly 12. Accordingly, the caregiver can access the child positioned in the seat member 22 from above, from in front, or from the side of the seat assembly 20 without interference from the frame assembly 12. These mating, curved shapes forming the frame assembly 12 establish an improved access, physically and visually, to the seat assembly 20 and any child positioned therein.

The assembly of the seat assembly 20 onto the frame apparatus 12 is accomplished through the use of hanger mounts 40, including a male attachment end 42 on the end of the hanger tube 25 and a female receptacle 47 attached to the pivot member 32 associated with the electric motor 29 extending outwardly through the hanger housing 28 to affect a reciprocal fore-and-aft motion to the seat assembly 20. The male attachment member 42 is formed with a rounded upper portion 43 and tapered side portions 44 to form a wedge-shaped configuration. Similarly, the female receptacle 47 is formed in a mating configuration to receive the male attachment end 42 within the formed slot 48. The tapered shape of the attachment components 42, 47 provide a positive engagement between the two components 42, 47 and effectively transfer torque from the drive motor 29 through the pivot member 32 into the hanger tube 25 to cause the fore-and-aft reciprocal movement of the seat assembly 20.

Figure 9:
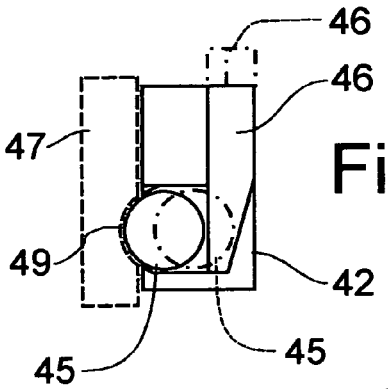
FIG. 9 is a cross-sectional detail view of the quick disconnect apparatus incorporated into the first embodiment of the attachment members depicted in FIGS. 7 and 8.

Preferably, a quick detach retention member 45 is preferably incorporated into the hanger mounts 40 to retain the male attachment end 42 within the female receptacle 45. The quick detach retention member 45 can take one of many forms, such as the ball 45 that is received within the attachment end 42, as is best depicted in FIG. 9. The ball 45 can be loosely received within a retention housing in the attachment end 42. When the hinged actuation lever 46 is pressed into the retention housing the geometry is such that the ball 45 is fixed into a protruding position with respect to the face of the attachment end. The protruding ball 45 is then engagable with a groove 49 formed in the female receptacle 47 to retain the male attachment end 42 within the slot 48 of the receptacle 47. A disconnection of the hanger tube 25 from the frame assembly 12 requires only that the actuation lever 46 be lifted so that the ball 45 is free to retract into the retention housing and release from the groove 49. One skilled in the art will recognize that other forms of retention devices would be equally applicable, including a spring-loaded retention ball 45 that retains the components 42, 47 together with the force exerted by the spring (not shown).

A second preferable form of the hanger mounts 50 can best be seen in FIGS. 10 and 11. The male receptacle 52 is affixed to the pivot member 32 extending through the hanger housing 28 from the electric motor 29. As with the first embodiment of the hanger mounts 40 described above, the male receptacle 52 is formed with a rounded upper portion 58 to facilitate the interconnection of the attachment end 55 with the receptacle 52. Also similar to the first embodiment of the hanger mounts 40 described above, the receptacle 52 is formed with linear side portions 59 that facilitate the transmission of torque from the drive motor 29 to the hanger tubes 25 to affect the reciprocal rocking motion for the swing seat assembly 20. The female attachment end 55 on the end of the hanger tube 25 is formed with a pocket that is sized and configured to receive in a geometrically mating relationship with the receptacle 52 such that the attachment end 55 can simply be slipped over the top of the male receptacle 52 to affect engagement therebetween.

The preferred form of the retention member is a retention clip 53 formed at the bottom portion of the male receptacle 52 so that the retention clip 53 will engage the receiver 56 formed on the bottom portion of the attachment end 55 and affect a locking engagement therebetween. Disengagement of the seat assembly 20 from the receptacle 52 can be affected by first grasping the attachment ends 55 and flexing the retention clip receiver 56 to separate the retention clip 53 from the receiver 56. The attachment ends 55 can then be slid upwardly off the corresponding receptacles 52 and pulled away from the frame assembly 12.

The above descriptions of the first and second embodiments 40, 50 of the hanger mounts reflect the drive side of the frame assembly 12. Typically, the two hanger housings 27, 28 are arranged that one of the hanger housings 28 has the drive motor 29 positioned therein, while the other hanger housing 27 is a "dummy" housing supporting only a pivot member (not shown) to permit the reciprocal movement of the seat assembly 20. The opposing "dummy" hanger housing 27 is configured essentially identically to the motor housing 28 except that the pivot member (not shown) is not driven.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A child swing comprising:

a seat assembly including a seat member and a pair of hanger members attached to said seat member for suspending said seat member in an elevated position;

a frame assembly supporting said seat assembly for reciprocal movement relative to said frame assembly;

a pair of hanger housings mounted on said frame assembly on opposing sides of said seat assembly, each said hanger housing having a pivot member extending outwardly of said hanger housing; and hanger mounts including an attachment end supported on a distal end of each said hanger member and a receptacle supported on each said hanger housing and having a configuration mating with said attachment end, said configuration including linear side portions so that torque transmitted by a drive motor to said pivot member can be transmitted to said hanger members for affecting reciprocal movement in said seat assembly.

2. The child swing of claim 1 wherein said hanger mounts have a rounded upper portion.

3. The child swing of claim 2 further comprising:

a retention device integrally formed with said hanger mounts for selectively retaining the engagement of said attachment end with the corresponding said receptacle.

4. The child swing of claim 3 wherein said retention device includes a retention clip and a retention clip receiver mounted respectively on said attachment end and said receptacle.

5. The child swing of claim 4 wherein said retention clip and said retention clip receiver engage automatically when said attachment ends are mounted on said receptacles.

6. The child swing of claim 5 wherein said attachment ends are mounted on said receptacles by sliding said attachment ends over top of said receptacles such that each said receptacle is received within a pocket formed in the corresponding said attachment end.

7. A hanger mount in combination with a child swing to connect a hanger member to a drive motor supported within a hanger housing, said hanger member forming part of a reciprocally movable seat assembly for permitting a drive motor to transfer torque to said seat assembly and create reciprocal movement, comprising:

a receptacle member mounted on said hanger housing in operative engagement with said drive motor, said receptacle member having a rounded upper portion and linear side portions;

an attachment end mounted on a distal end of said hanger member, said attachment member having a rounded upper portion and linear side portions corresponding to said receptacle member, said attachment end being engagable with said receptacle member such that said respective rounded upper portions are interengaged, said linear side portions of said receptacle member and said attachment end being mated to facilitate the transfer of torque from said drive motor to said hanger member through said interengaged receptacle member and attachment end.

8. The hanger mount of claim 7 further comprising:

a retention device associated with both said receptacle member and said attachment end such that said retention device is engaged in response to said receptacle member and said attachment end being interengaged.

9. The hanger mount of claim 8 wherein said attachment end is formed with a pocket for receiving said receptacle member in a geometrically mating relationship.

10. The hanger mount of claim 9 wherein said attachment end is positionable over top of said receptacle member to affect engagement therebetween.

11. The hanger mount of claim 8 wherein said retention device includes a retention clip and a retention clip receiver mounted respectively on said attachment end and said receptacle member.

12. The hanger mount of claim 11 wherein said retention clip and said retention clip receiver engage automatically when said attachment end is mounted on said receptacle member.

13. The hanger mount of claim 8 wherein said receptacle member is formed with a pocket for receiving said attachment end in a geometrically mating relationship.

14. The hanger mount of claim 13 wherein said linear side portions of said receptacle member and said attachment end are non-parallel to define a wedge-shaped configuration.

15. In an infant swing having a frame assembly supporting a seat assembly for reciprocal movement relative to said frame assembly, said frame assembly including a pair of transversely opposing hanger housings, including a drive hanger housing in which is supported a drive motor for powering the reciprocal movement of said seat assembly, said seat assembly including a pair of hanger members connected to a seat member and extending upwardly therefrom for engagement with said hanger housings for support thereof, the improvement comprising:

a receptacle member mounted on each said hanger housing in operative engagement with respective pivot members to facilitate said reciprocal movement of said seat assembly, one of said pivot members being operatively connected to said drive motor, said receptacle member having a non-circular geometric configuration including at least one linear side portion;

an attachment end mounted on a distal end of each said hanger member, said attachment member having a non-circular geometric configuration that is sized to mate with the corresponding said receptacle member and including a mating linear side portion to the at least one linear side portion of said receptacle member, the corresponding said attachment end and said receptacle being selectively engagable in a geometrical mating relationship to facilitate the transfer of torque from said drive motor to said hanger members through said interengaged corresponding receptacle member and attachment end.

16. The infant swing of claim 15 wherein said non-circular geometric configuration includes a rounded upper portion on both said receptacle member and said attachment end.

17. The infant swing of claim 16 further comprising:

a retention device associated with both said receptacle member and said attachment end such that said retention device is engaged in response to said receptacle member and said attachment end being interengaged.

18. The infant swing of claim 17 wherein said attachment end is formed with a pocket for receiving said receptacle member in a geometrically mating relationship, said attachment end being positionable over top of said receptacle member to affect engagement therebetween.

19. The infant swing of claim 18 wherein said retention device includes a retention clip and a retention clip receiver mounted respectively on said attachment end and said receptacle member, said retention clip and said retention clip receiver engaging automatically when said attachment end is mounted on said receptacle member.

20. The infant swing of claim 17 wherein said linear side portions of said receptacle member and said attachment end are non-parallel to define a wedge-shaped configuration.

* * * * *